US010765910B2

(12) United States Patent
Salamone

(10) Patent No.: US 10,765,910 B2
(45) Date of Patent: Sep. 8, 2020

(54) YOGA MAT BARRIER

(71) Applicant: Michael D. Salamone, Roslindale, MA (US)

(72) Inventor: Michael D. Salamone, Roslindale, MA (US)

( * ) Notice: Subject to any disclaimer, the term of this patent is extended or adjusted under 35 U.S.C. 154(b) by 67 days.

(21) Appl. No.: 16/149,265

(22) Filed: Oct. 2, 2018

(65) Prior Publication Data

US 2019/0262658 A1 Aug. 29, 2019

Related U.S. Application Data

(60) Provisional application No. 62/635,136, filed on Feb. 26, 2018, provisional application No. 62/635,974, filed on Feb. 27, 2018.

(51) Int. Cl.

| | |
|---|---|
| ***A63B 21/00*** | (2006.01) |
| ***A63B 69/00*** | (2006.01) |
| ***A63B 71/06*** | (2006.01) |
| ***A61H 15/00*** | (2006.01) |

(52) U.S. Cl.

CPC ..... *A63B 21/4037* (2015.10); *A63B 69/0057* (2013.01); *A61H 2015/0014* (2013.01); *A63B 2071/0602* (2013.01); *A63B 2071/0694* (2013.01); *A63B 2225/09* (2013.01)

(58) Field of Classification Search

CPC ..... A63B 21/4037; A61H 2015/0014

See application file for complete search history.

(56) References Cited

U.S. PATENT DOCUMENTS

| | | | | |
|---|---|---|---|---|
| 1,616,065 | A * | 2/1927 | Rosenquist | A61H 1/001 601/115 |
| 3,633,905 | A * | 1/1972 | Etchelecou | A63B 26/003 472/127 |
| 5,125,883 | A * | 6/1992 | Shoebrooks | A63B 21/4039 482/121 |
| 6,071,253 | A * | 6/2000 | Rivera | A61H 1/0292 601/118 |
| D430,627 | S * | 9/2000 | Bergman | D21/662 |
| 6,751,816 | B1 * | 6/2004 | Wechsler | A45F 3/14 383/4 |
| 2005/0049532 | A1 * | 3/2005 | Lee | A61H 15/00 601/118 |
| 2006/0223683 | A1 * | 10/2006 | Orona | A63B 21/4039 482/96 |

(Continued)

*Primary Examiner* — Jennifer Robertson

(74) *Attorney, Agent, or Firm* — Parker Keough LLP; Robbie J. Reutzel, Esq.

(57) ABSTRACT

A yoga mat accessory is described employing a barrier that attaches to a yoga mat, separating it into a rear section and a front section. The barrier enhances a yoga exercise by requiring the Subject to step over the barrier when changing yoga positions. The barrier is positioned at a specific location and is held to the yoga mat using mat connectors. The mat connectors may employ a spindle which fits into the ends of a roller barrier to hold it. The mat connectors have vertical supports which attach to an end of the spindle and to a base. The base is positioned under the yoga mat to hold an edge of the yoga mat. In alternative embodiments, the barrier has a curved top surface and a flat base. In another embodiment, the elongated body has a first portion which fits into a second portion to adjust the width of the barrier to retrofit existing yoga mats.

9 Claims, 9 Drawing Sheets

(56) References Cited

U.S. PATENT DOCUMENTS

| | | | | |
|---|---|---|---|---|
| 2010/0299833 | A1* | 12/2010 | Kessler | A63B 21/4037 5/417 |
| 2013/0324382 | A1* | 12/2013 | Wilson | A63B 21/4039 482/142 |
| 2014/0171279 | A1* | 6/2014 | Justice Velasco | A63B 26/00 482/142 |
| 2018/0125746 | A1* | 5/2018 | Kokakis | A63B 21/4043 |
| 2018/0353797 | A1* | 12/2018 | Lin | A63B 1/00 |

* cited by examiner

YOGA MAT BARRIER

CROSS-REFERENCE TO RELATED APPLICATIONS

This patent application claims priority to U.S. Patent application 62/635,136 entitled "Yoga Dragon. A Soft Tube Designed to Hook, and/or Fix onto a Yoga Mat" filed on Feb. 26, 2018; and 62/635,974 entitled "Yoga Dragon. A Soft Tube Designed to Hook, and/or Fix onto a Yoga Mat" filed on Feb. 27, 2018 both by Michael D. Salamone, that are hereby incorporated by reference to the extent that they do not conflict with this application.

STATEMENT REGARDING FEDERALLY SPONSORED RESEARCH

Not Applicable.

BACKGROUND

1. Field of Invention

The present invention relates to a barrier that attaches to a yoga mat, and more specifically to a barrier that attaches to a yoga mat, and said barrier remains stationary during a yoga exercise.

2. Description of Related Art

When performing yoga positions and moves, there are transitions from one position to another. These are to be performed in a certain manner. For example, there may be one position in which the person's feet are on the rear part of the yoga mat and his/her feet must be moved to a position on the front part of the yoga mat. He/she does this by lifting one foot from the back portion of the yoga mat and then planting it on the front portion of the yoga mat, while otherwise maintaining the yoga position. He/she then repeats the move with the other foot. This is to be done properly by lifting one's feet (not dragging them), then placing the feet on the front portion of the yoga mat.

In order that the transition may be performed properly, there is usually a barrier or divider that is several inches high that runs across the mat between the rear portion of the mat and the front part of the mat.

As the person transitions his/her feet from the back to the front portion of the yoga mat, he/she must step over the barrier. It is more difficult to lift one's feet over the barrier than to drag the feet from the rear portion to the front portion of the yoga mat.

Therefore, the barrier prevents the person from dragging his/her feet from the rear of the mat toward the front of the mat and thereby causes him/her to step over the barrier, which is a more difficult maneuver and provides a better workout than simply dragging the feet.

Typically, users just place a firm block across the mat between the front and rear portions of the yoga mat. Since this block is not held in place, the block is typically moved if accidently touched or kicked.

Also, the degree of difficulty increases as the barrier is moved toward the front portion. Since there are no markings, it is difficult to gauge where to place the barrier. Also, since there are no markings, it is difficult to quantify the location of the barrier and the difficulty. Therefore, the user cannot identify if he/she is advancing over time.

Currently, there is a need for a yoga accessory that holds a barrier in place to ensure that the user performs the yoga transitions properly.

BRIEF DESCRIPTION OF THE DRAWINGS

The advantages of the system described in this application will become more apparent when read with the exemplary embodiments described in the specification and shown in the drawings. Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

The present invention will now be described in detail by describing various illustrative, non-limiting embodiments thereof with reference to the accompanying drawings. The invention may, however, be embodied in many different forms and should not be construed as being limited to the illustrative embodiments set forth herein. Rather, the embodiments are provided so that this disclosure will be thorough and will fully convey the concept of the invention to those skilled in the art. The claims should be consulted to ascertain the true scope of the invention.

1. Theory

Those who practice the physical aspects of yoga work through a series of yoga positions. The person performing the yoga positions will be referred to as a 'Subject'. It is a goal of the Subject to perform each pose or position with accuracy to improve physical and mental discipline.

It is another goal of the invention to capture the physical experience of Subject incorporating the equipment of the current invention into their practice of the practice of Vinyasa and other select Asana.

Yoga is typically practiced on a yoga mat on a floor. In most cases, the Subject travels to a location where there is a yoga class. Each one brings his/her own personal yoga mat for the exercise. Therefore, the yoga mat and any other equipment used for the yoga class must be small and easy to carry.

There are transitions from one pose to another in which the Subject should lift at least one part of the body and position it at a different location. It takes more effort and discipline to lift and place as opposed to dragging across the yoga mat. Therefore, it is best to prevent dragging and instead direct the Subject toward lifting and placing, to promote the proper way to exercise.

In the past some have used yoga blocks for this purpose. Since they are rectangular or cube-shaped, the corners tend to catch onto the Subject and move. Once they move, they are no longer in the proper place to aid in the yoga exercise. The Subject must then stop the exercise, set up the blocks properly, then resume his/her exercise. This can become frustrating and time-consuming.

2. Implementation

The current invention may be implemented several different ways, each referred to as an 'embodiment'.

Figure 1B:
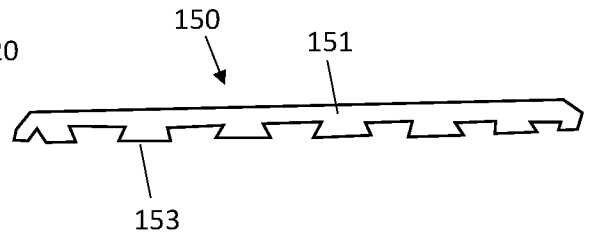
FIG. 1B is a side elevational view of an extension piece compatible with the extendable barrier of FIG. 1A.
Figure 1A:
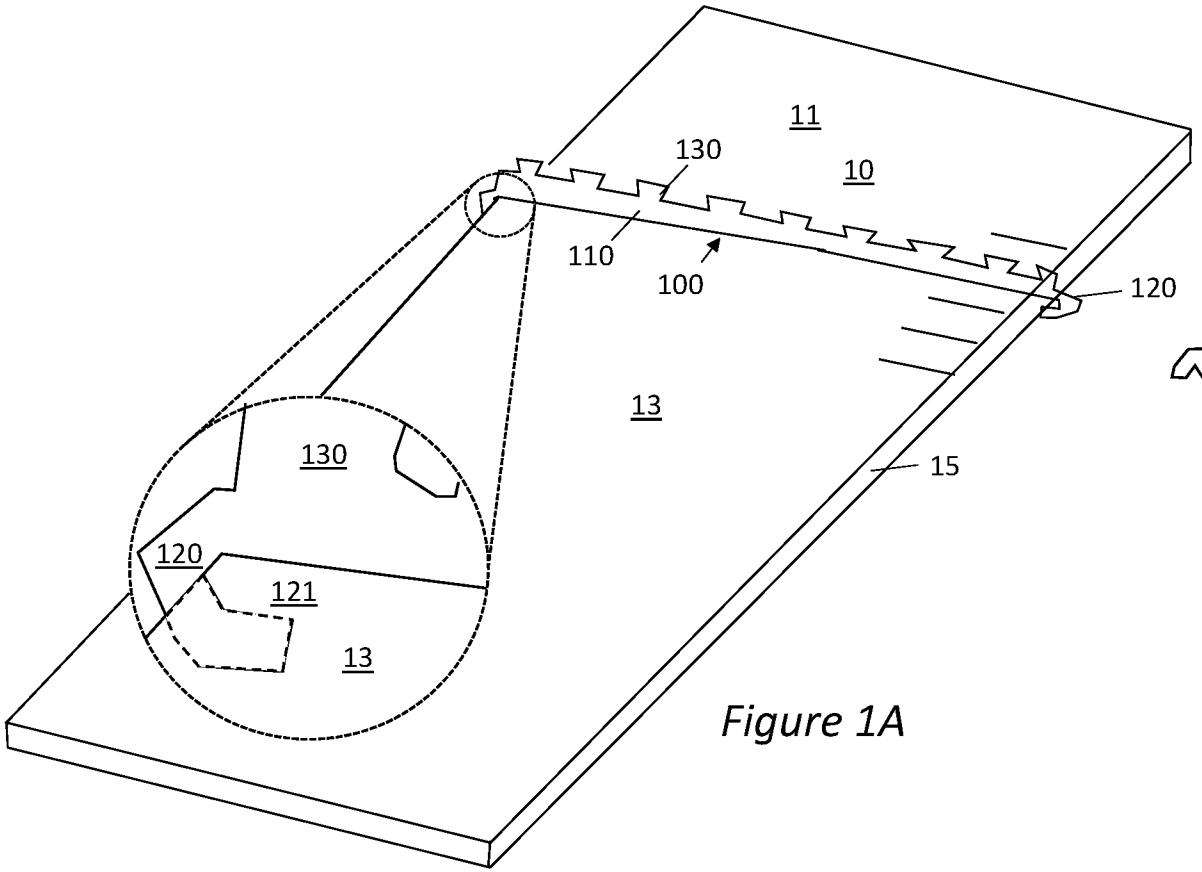
FIG. 1A is a perspective view of a simplified embodiment of an extendable barrier according to the current invention attached to a yoga mat, exhibiting extendable height.

A first embodiment is shown in FIG. 1A. This is a perspective view of a simplified embodiment of an extendable barrier 100 attached to a yoga mat 10. The extendable barrier 100 is attached to the yoga mat 10 delineating a rear portion 11 of the yoga mat 10 and a front portion 13 of the yoga mat 10.

Extendable barrier 100 has an elongated body 101 that employs side extensions 120. Each side extension 120 includes a mat edge notch 121. These edge notches 121 are shaped, sized and positioned to receive and retain a side edge 15 of yoga mat 10. The left side extension 120 and edge notch 121 are shown in an enlarged image in FIG. 1A. The extensions 120 and edge notches 121 are designed to receive and hold side edges 15 between them, holding the extendable barrier 100 upright. Now the Subject must lift his/her feet over the extendable barrier 100 instead of simply dragging them from the front portion 13 to the rear portion 11 (or from the rear portion 11 to the front portion 13, as the case may be), thereby adding to the difficulty of the exercise.

When the Subject has advanced to the point where he/she requires an additional challenge, the extension piece 150 may be implemented to increase the barrier height.

FIG. 1B is a side elevational view of an optional extension piece 150 compatible with the barrier 100 of FIG. 1A. Extension piece 150 employs an elongated body 151 and an interlocking bottom edge 153. If required, the interlocking bottom edge 153 of extension piece 150 can be used to attach to interlocking edge 130 of extendable barrier 100. This increases the height of the extendable barrier 100 for increased difficulty.

Figure 2B:
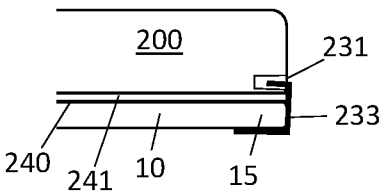
FIG. 2B is an enlarged, partial, cut-away view through a mat attachment of the embodiment of FIG. 2A.
Figure 2A:
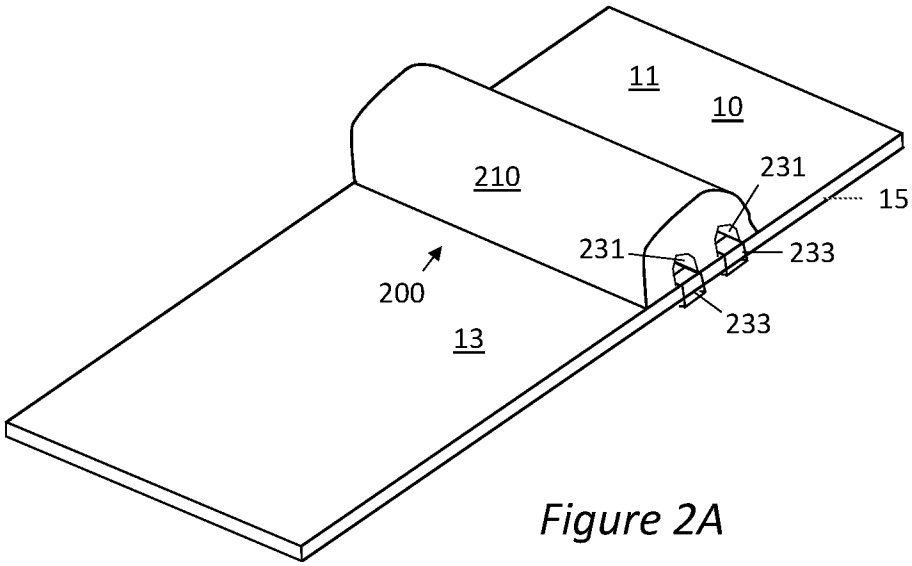
FIG. 2A is a perspective view of a simplified embodiment of another barrier attachment system according to the current invention attached to a yoga mat.

FIG. 2A is a perspective view of a simplified embodiment of a curved barrier 200 attached to a yoga mat 10. Curved barrier 200 is attached to the yoga mat.

This embodiment employs an elongated body that has a curved top surface 210. This allows one to lift arms, legs or feet over the barrier easily without catching on edges or corners.

Preferably, the barrier has a flat bottom (FIG. 2B, 240), preferably with a rigid plate (FIG. 2B, 241). It employs a plurality of clip ports 231 near the bottom edge of the curved barrier 200.

There may be clips 223 or other fasteners which fit into the clip ports 231 and secure the curved barrier 200 to the yoga mat edges 15.

FIG. 2B is an enlarged, partial, cut-away view showing the edge 15 of the yoga mat 10 attached to the curved barrier 200 by clips 233. Here is more clearly shown that the clips 233 attach to and hold the bottom 240 (or rigid plate 241) of curved barrier 200 to the yoga mat 10. More specifically, the clips 233 hold the bottom 240/rigid plate 241 to the edges 15 of yoga mat 10.

Figure 3B:
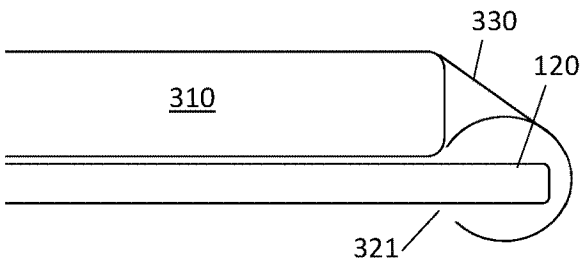
FIG. 3B is an enlarged, partial, cut-away view through one side of the barrier attachment system of the embodiment of FIG. 3A.
Figure 3A:
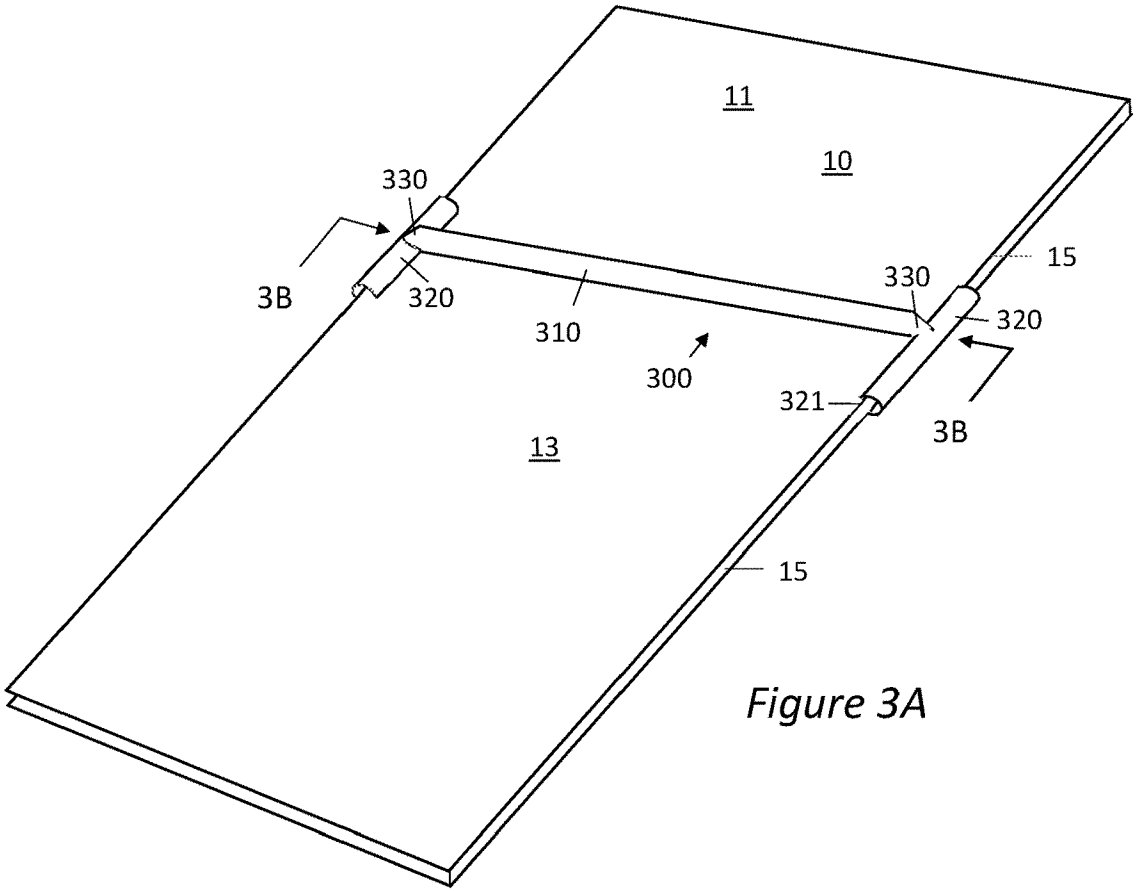
FIG. 3A is a perspective view of another embodiment of a barrier attachment system according to the current invention attached to a yoga mat.

FIG. 3A is a perspective view of another embodiment of a tubular barrier 300 attached to a yoga mat. In this case, the tubular barrier 300 only has a height that is approximately equal to the outside diameter of the tubular crossbar 310. This embodiment employs a slotted side piece 320 attached to either side of the tubular crossbar 310. The slotted side pieces each have a slot 321 cut into their inner side, sized to snugly accept the edge 15 of the yoga mat.

Since the crossbar is intended to extend across and rest upon the top surface of yoga mat 10, there must be an offset connection 330 between the tubular cross bar 310 and each slotted side piece 320.

FIG. 3B is an enlarged, partial, cut-away view through one side of the barrier attachment system of the embodiment of FIG. 3A. It can be seen that the cross bar 310 is about one-half of the cross-bar diameter above the slotted side pieces 320. This allows the cross bar 310 to be above and rest upon the yoga mat 10. Also, if the Subject falls or leans on the cross bar 310, the pressure translates to the slotted side pieces 320. The downward pressure causes the slotted side pieces 320 to close slot 321, thereby pinching edges 15 of the yoga mat 10. This pinching increases the grip of the slotted side pieces 320 on the edges 15 of yoga mat 10 at a time when there is a force trying to move the tubular barrier 300. Therefore, it exhibits the strongest grip at the time it needs the grip the most.

This tubular barrier embodiment allows for quick assembly and disassembly. Since it can be constructed from readily available PVC piping, it can be inexpensive, lightweight and durable and can easily be carried to a yoga session and quickly setup. It can also be disassembled quickly and carried home.

Figure 4B:
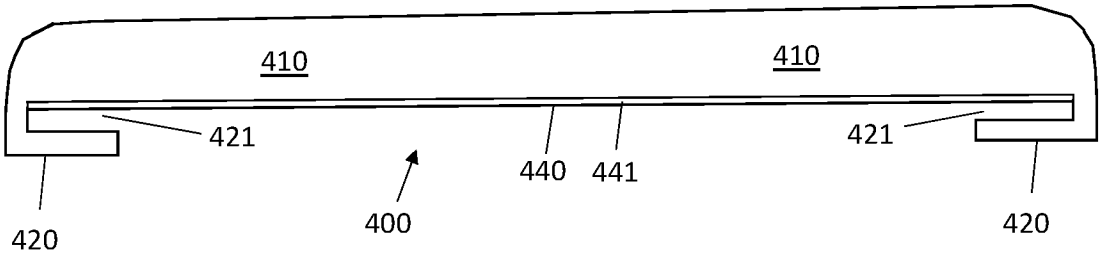
FIG. 4B is an enlarged side elevational view of the barrier of FIG. 4A.
Figure 4A:
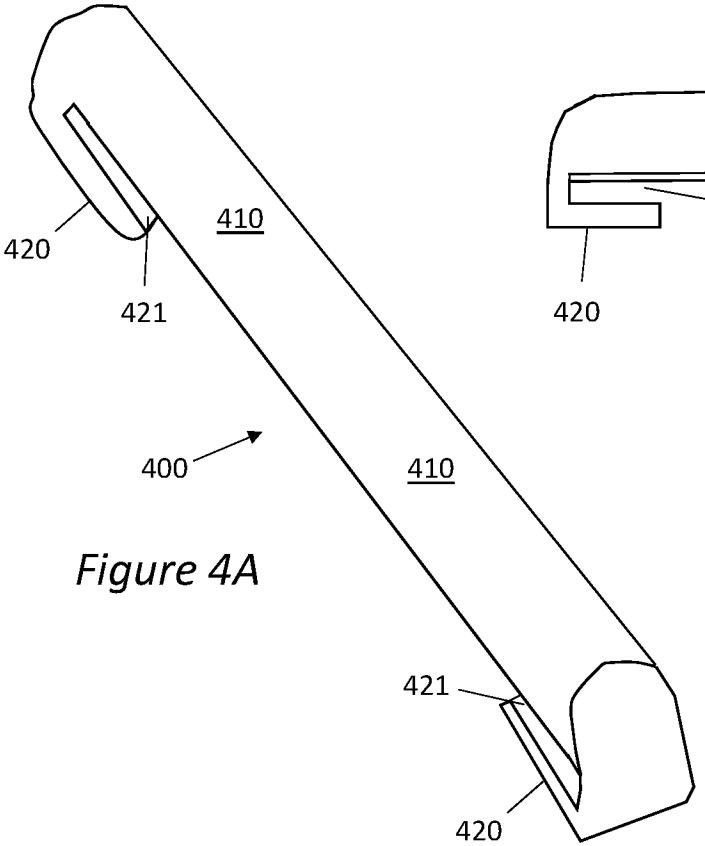
FIG. 4A is a perspective view of another embodiment of a barrier attachment system according to the current invention attached to a yoga mat.

FIG. 4A is a perspective view of another embodiment of a padded barrier according to the current invention attached to a yoga mat. In this embodiment, there is an elongated body 410, preferably padded, having two ends. There is a lower extension 420 protruding from the bottom of the elongated body at each end. The lower extension 420 forms an edge notch 421 sized and shaped to snugly receive and hold the edges 15 of the yoga mat (15 of FIGS. 1A, 2A, 3A). Typical dimensions of the padded barrier 400 would be a 24 inch elongated body 410 sized to match standard yoga mats. For stability, the lower extensions may be 3-4 inches long. A longer extension results in more holding force.

FIG. 4B is an enlarged side elevational view of the padded barrier 400 of FIG. 4A. The lower extensions 420 and edge notches are more easily seen in this view.

Figure 5:
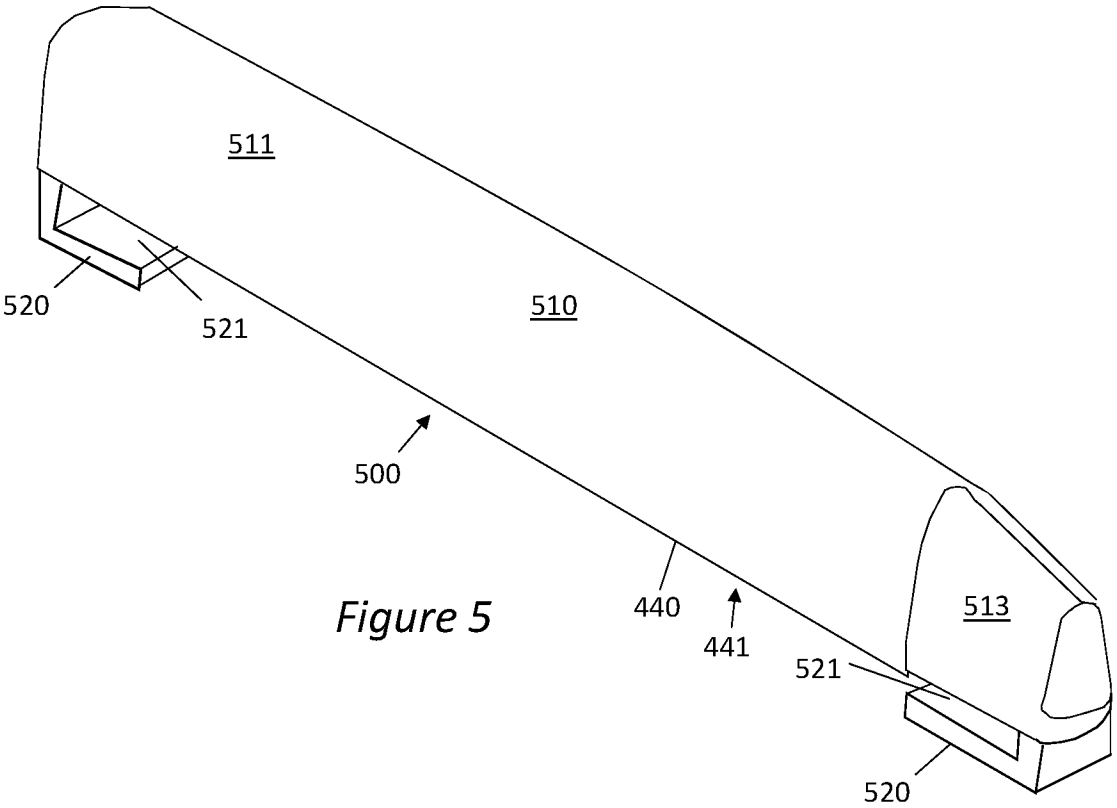
FIG. 5 is a perspective view of another embodiment of a barrier attachment system according to the current invention, exhibiting extendable width.

Since yoga mats are sold in different sizes and widths, it would be beneficial to be able to adjust the barrier to retrofit the yoga mats. FIG. 5 is a perspective view of another embodiment of an extendable barrier 500 according to the current invention, exhibiting extendable width.

The extendable barrier 500 has an elongated body 510. The elongated body 510 has a first portion 511 and a second portion 513. The second portion 513 is shaped and sized to fit within the first portion 511. This allows the extendable barrier 500 to adjust to extend across various sized yoga mats 10.

This embodiment employs a lower extension 520 which forms an edge notch 521. The extendable body 510 may be extended wider than the width of the yoga mat 10, then shortened such that the mat edges 15 fit within the edge notches 521.

Even though this embodiment is shown using lower extensions and edge notches, any other attachment means disclosed in this application may also be used.

In one embodiment, the second portion 513 fits snugly within first portion 511, thereby resisting extension by friction. This causes the lower extensions 520 and edge notches 521 to securely hold yoga mat 10.

In other embodiments, known connection devices may be used to prevent the first portion 511 from moving relative to the second portion 513. These may include pins, clips, hook-and-loop attachments, etc.

Figure 6A:
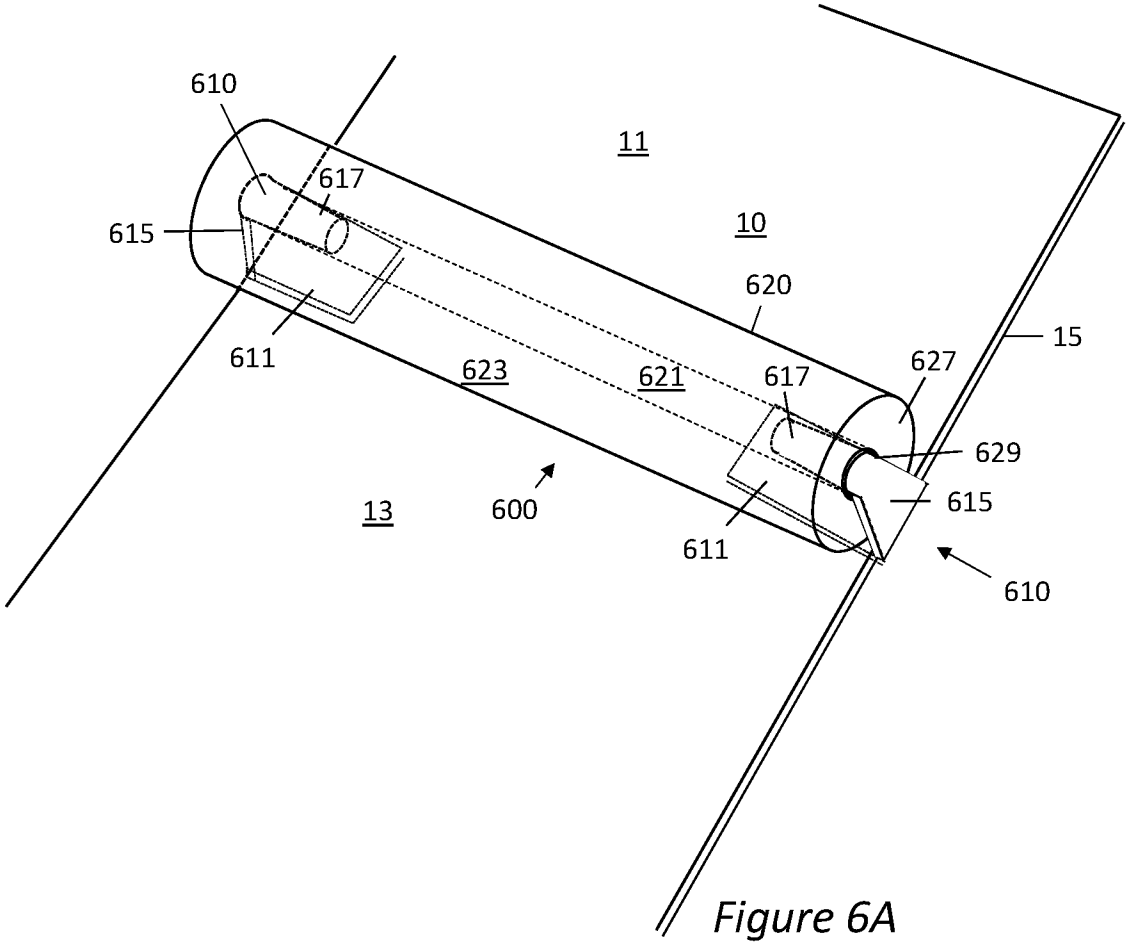
FIG. 6A is a perspective view of an embodiment of a roller barrier according to the current invention, attached to a yoga mat.

FIG. 6A is a partial perspective view of an embodiment of a roller barrier 600 according to the current invention attached to a yoga mat 10 with mat connectors 610. This specific mat barrier 600 employs a roller body 620 having two sides 627 each having an orifice 629 in each side.

The roller body has a generally cylindrical shape that is made of a structural material 623 which is pliable and easily deformable.

Spindles 617 which are generally cylindrical and horizontal when in use, are inserted into the orifices 629 to hold the roller body 620 against yoga mat 10.

The spindle 617 is connected at one of its ends to a vertical support 615 which extends vertically downward to connect to a base 611 positioned under the yoga mat 10. In this way, if the Subject falls on the roller barrier 600, the Subject's weight on the roller body 620 causes the roller barrier to press on the yoga mat 10, causing increased friction to hold the yoga mat 10 in place.

This force is transmitted downward causing the yoga mat 10 to press against the base 611 increasing friction between the yoga mat 10 and the base 611. The yoga mat 10 is therefore 'sandwiched' between the roller body and the base 611, increasing the ability to hold the roller barrier 600 in place relative to the yoga mat 10.

Optionally, there is a retaining ridge 613 on base 611 which increases the ability of the base 611 to grip the edges 15 of yoga mat 10.

Also, optionally, the orifices 629 extend as an internal recess 621 through roller body 620. The diameter of the recess determines the rigidity of the roller body 620.

There may also be an internal tube extending through the internal recess 621 which may provide additional support or rigidity.

In the optional embodiment above, if the internal tube is strong enough, a mat connector may be used with a higher spindle 617 to cause the roller body 620 to be lifted off the yoga mat surface allowing it to rotate around the spindles 617. In this case, the Subject may lean upon the roller body 620 and roll against it for stretching and massaging purposes.

FIGS. 6B-6E are various views of the mat connector of FIG. 6A.

Figure 6E:
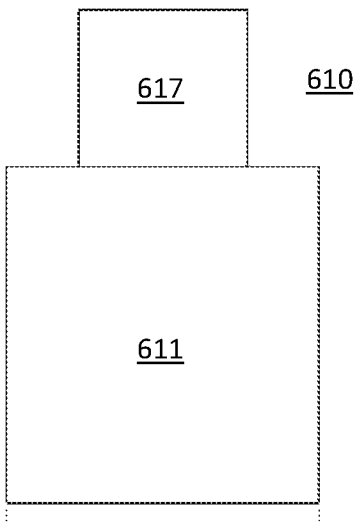
FIGS. 6B-6E are various views of the mat connector of FIG. 6A.
Figure 6D:
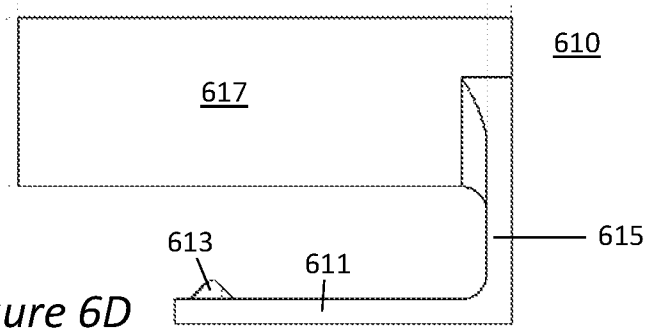
Figure 6B:
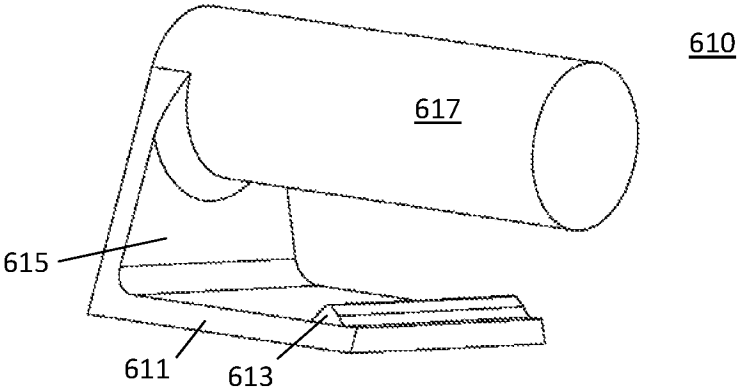

FIG. 6B shows an enlarged perspective illustration of the mat connector 610 of FIG. 6A showing the base 611, retaining ridge 613, vertical support 615, and spindle 617.

Figure 6C:
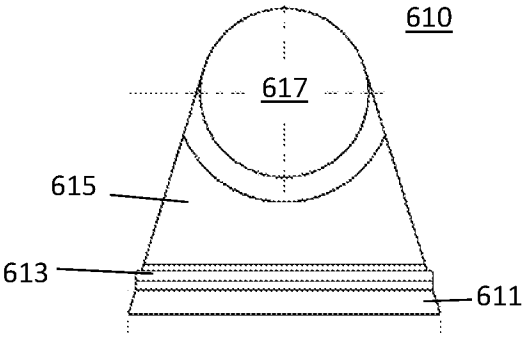

FIG. 6C is a front elevational view of the mat connector 610 from the end of the spindle 617.

FIG. 6D is a side elevational view of the mat connector 610. Here the shape of the retaining ridge 613 may be seen more clearly.

FIG. 6E is a plan view of the mat connector 610 from the bottom. The bottom of base 611 and spindle 617 are visible.

Figure 7:
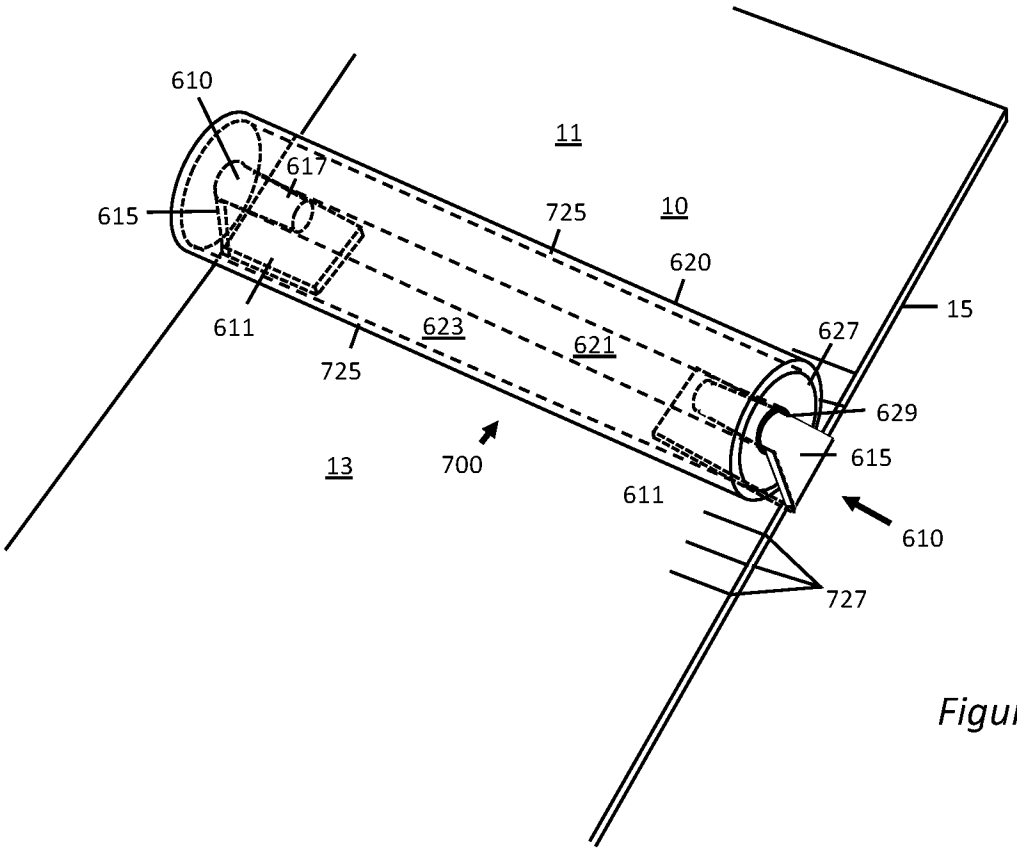
FIG. 7 is a perspective view of an embodiment of a roller barrier according to the current invention, attached to a yoga mat.

FIG. 7 is a partial perspective view of another embodiment of a roller barrier 600 according to the current invention attached to a yoga mat 10 with mat connectors 610. This embodiment employs all the same structures as described for FIG. 6A that function in the same manner as described for FIG. 6A, with the exception that the roller body 620 employs a durable outer covering 725. It was found that covering the foam rubber used for the structural material 623 with neoprene increases its structural integrity and allows it to function better. It also makes the roller body 620 more rigid.

In an alternative Yoga Roller Embodiment, the foam roller body 620 may be detached form the yoga mat 10 of FIG. 7. The foam roller body 620, may be used by the Subject, by to promote muscular release and relaxation. This is done by the Subject moving his/her body over the cylindrical surface such that it rolls. This is the first and only self-massage implement designed to attach securely to your yoga mat and be rolled conveniently within it for easy transport.

Vinyasa-Focused (Active)

The primary function of the current invention it that of a vinyasa trainer helping Subjects to improve their alignment and strength during the vinyasa-focused, active portions of the Yoga exercise. As a Subject builds his/her practice, they will move the placement of a yoga mat barrier from towards the back of the mat (Beginners), to the center of the mat (Intermediate), to toward the toward the top edge of the mat (Advanced).

Restorative/Yin Postures (Passive)

When the active practice or vinyasa work is over, the yoga mat barrier can be used to support parts of the body during restorative postures.

Muscular Release (Foam Rolling)

When both the active and restorative practice is complete, the roller barrier can be easily detached from the mat by removing the end clips. The YFR can then be used as a traditional foam roller to encourage muscular release and recovery.

In an alternative embodiment, there may be a sticker or other label having numbered or lettered markings 727 indicating locations to attach the barrier 700.

Alternatively, the markings may be directly marked on the yoga mat 10 and purchased with the other parts. These marking features may be implemented in this, and any of the previous embodiments.

Since the Subject may lie upon and/or roll over the roller barrier 600, it may cause discomfort. This is especially true if he/she lies directly upon one of the mat connectors 610. The vertical support 615 and spindle 617 are made of rigid material and can jab the Subject, even through the roller body 620. Therefore, another alternative embodiment is described which minimizes this problem.

Figure 8:
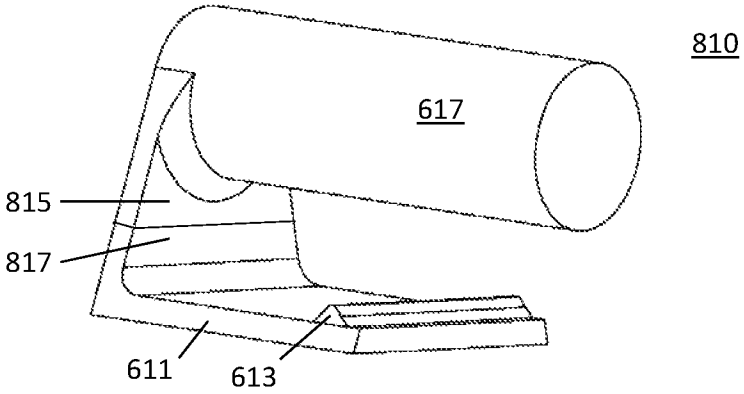
FIG. 8 is a perspective view of another embodiment of a mat connector.

FIG. 8 shows a perspective view of an alternative embodiment of the mat connector 810. In this embodiment, the vertical support 615 is replaced by a top vertical support section 815 which is sized and shaped to fit into a bottom vertical support section 817. A spring or other urging device may be used to fully extend the vertical supports 815, 817 relative to each other when in normal use.

However, when the Subject lies upon the vertical supports, 815, 817, the top vertical support 815 may be pushed into the bottom vertical support section 817, minimizing the discomfort to the Subject. Please note that it is within the spirit of the invention, that these may be reversed in which the bottom vertical support section 817 slides within the top vertical support section 815.

While the present disclosure illustrates various aspects of the present teachings, and while these aspects have been described in some detail, it is not the intention of the applicant to restrict or in any way limit the scope of the claimed systems and methods to such detail. Additional advantages and modifications will readily appear to those skilled in the art. Therefore, the teachings of the present application, in its broader aspects, are not limited to the specific details and illustrative examples shown and described. Accordingly, departures may be made from such details without departing from the spirit or scope of the teachings of the present application. Moreover, the foregoing aspects are illustrative, and no single feature or element essential to all possible combinations may be claimed in this or a later application.

I claim:

1. A yoga mat barrier assembly for attaching to a yoga mat having two edges, between an upper portion and a lower portion of the yoga mat, comprising:

a. a roller body having a generally cylindrical shape with two substantially parallel flat sides and an orifice in each side;

b. wherein the roller barrier is positioned upon across the yoga mat; and c. mat connectors having a spindle which fits into one of the orifices, when in use;

d. wherein the mat connectors attach the roller body to the edges of the yoga mat.

2. The yoga mat barrier assembly of claim 1 further comprising:

markings on the yoga mat to indicate locations to attach the mat connectors.

3. The yoga mat barrier assembly of claim 1 further comprising:

a. a vertical support is connected to the spindle extending downward, b. a base connects to the vertical support and extends substantially horizontally under the yoga mat when in use.

4. The yoga mat barrier assembly of claim 3, wherein the vertical support comprises:

a. a bottom vertical support section, and b. a top vertical support section which is sized and shaped to slide within the bottom vertical section reducing a vertical height of the vertical support.

5. The yoga mat barrier assembly of claim 4, further comprising:

an urging device which urges the top vertical support section to extend out of the bottom vertical support section.

6. The yoga mat barrier assembly of claim 1 wherein the roller body is detachable.

7. The yoga mat barrier assembly of claim 1, further comprising a durable layer enclosing the roller body.

8. The yoga mat barrier assembly of claim 7, wherein the durable layer is comprised of neoprene.

9. The yoga mat barrier assembly of claim 1 wherein:

a. the roller body comprises an internal recess passing through its length; and b. further comprising a tube extending through the internal recess connected to the spindles to provide additional support for the roller body.

* * * * *